US010619913B2

(12) United States Patent
Grant et al.

(10) Patent No.: US 10,619,913 B2
(45) Date of Patent: Apr. 14, 2020

(54) BODY COOLING ASSEMBLY

(71) Applicants: Michael Grant, San Diego, CA (US); Steven Grant, Sr., San Diego, CA (US)

(72) Inventors: Michael Grant, San Diego, CA (US); Steven Grant, Sr., San Diego, CA (US)

( * ) Notice: Subject to any disclaimer, the term of this patent is extended or adjusted under 35 U.S.C. 154(b) by 275 days.

(21) Appl. No.: 15/725,098

(22) Filed: Oct. 4, 2017

(65) Prior Publication Data

US 2019/0101322 A1 Apr. 4, 2019

(51) Int. Cl.

| | |
|---|---|
| ***F25D 23/10*** | (2006.01) |
| ***F25B 13/00*** | (2006.01) |
| ***F25B 49/02*** | (2006.01) |
| ***F25D 17/06*** | (2006.01) |
| ***F25B 39/00*** | (2006.01) |
| ***A41D 13/00*** | (2006.01) |
| ***A41F 9/00*** | (2006.01) |
| ***A41D 13/005*** | (2006.01) |

(52) U.S. Cl.

CPC ..... *F25D 23/10* (2013.01); *A41D 13/00* (2013.01); *F25B 13/00* (2013.01); *F25B 39/00* (2013.01); *F25B 49/02* (2013.01); *F25D 17/06* (2013.01); *A41D 13/0053* (2013.01); *A41F 9/002* (2013.01); *F25B 2339/047* (2013.01)

(58) Field of Classification Search

CPC . A41D 13/0053; F25D 2400/26; A61B 18/02; A61F 7/00; A61F 2007/0001

See application file for complete search history.

(56) References Cited

U.S. PATENT DOCUMENTS

| | | | | |
|---|---|---|---|---|
| 3,869,871 | A * | 3/1975 | Rybalko | A62B 17/005 62/178 |
| 4,095,593 | A * | 6/1978 | Webbon | B64G 6/00 128/202.11 |
| 6,295,648 | B2 | 10/2001 | Siman-Tov et al. | |
| D453,055 | S | 1/2002 | Ode | |
| 7,117,687 | B2 | 10/2006 | Naaman | |
| 7,249,464 | B1 | 7/2007 | Watson | |
| 7,331,183 | B2 | 2/2008 | Askew | |
| 7,472,560 | B2 * | 1/2009 | Karch | A61F 7/02 62/259.3 |
| 9,204,676 | B2 | 12/2015 | Bujold | |
| 2010/0107657 | A1 | 5/2010 | Vistakula | |

(Continued)

FOREIGN PATENT DOCUMENTS

WO WO2011032288 3/2011

*Primary Examiner* — Cassey D Bauer

(57) ABSTRACT

A body cooling assembly for cooling parts of a body includes a belt that is extendable around a waist. A housing is mounted on the belt includes a top wall, a bottom wall and a perimeter wall that extends between and is attached to the top and bottom wall. The housing has a first aperture and a second aperture for taking in and expelling air. A cooling unit is mounted in the housing. When actuated the cooling unit draws air into the housing, cools the air and dispends the cold air outwardly. A plurality of tubes is fluidly coupled to the housing and in thermal communication with the cooling unit such that air moves through the cooling unit and exits the housing through the tubes. The tubes are positionable on parts of a body and have a plurality of vent holes wherein each tube releases air.

8 Claims, 4 Drawing Sheets

(56) References Cited

U.S. PATENT DOCUMENTS

| | | | | |
|---|---|---|---|---|
| 2010/0236267 | A1* | 9/2010 | Korytnikov ..... | F24F 5/0035<br>62/259.3 |
| 2015/0374046 | A1* | 12/2015 | Peavy ..... | F24F 5/0035<br>62/406 |

* cited by examiner

BODY COOLING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR Not Applicable

BACKGROUND OF THE INVENTION

(1) Field of the Invention

(2) Description of Related Art Including Information Disclosed Under 37 CFR 1.97 and 1.98

The disclosure and prior art relates to cooling devices and more particularly pertains to a new cooling device for cooling parts of a body.

BRIEF SUMMARY OF THE INVENTION

An embodiment of the disclosure meets the needs presented above by generally comprising a belt that is configured to extend around the waist of a person. A housing is mounted on the belt and is comprised of a top wall, a bottom wall and a perimeter wall that extends between and is attached to the top wall and the bottom wall. The housing has a first aperture that extends therein for the intake of ambient air from outside of the housing. The housing has a second aperture configured to expel air from inside the housing. A cooling unit is mounted in the housing. The cooling unit draws ambient air into the housing, cools the ambient air to define cold air and dispends the cold air outwardly from the housing when the cooling unit is turned on.

A plurality of tubes is fluidly coupled to the housing and is in thermal communication with the cooling unit such that air moves through the cooling unit and exits the housing through the tubes. Each of the tubes has a plurality of vent holes therein. Each of the vent holes releases air from each of the tubes. Each of the tubes is configured to be positioned on parts of a body of the person.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
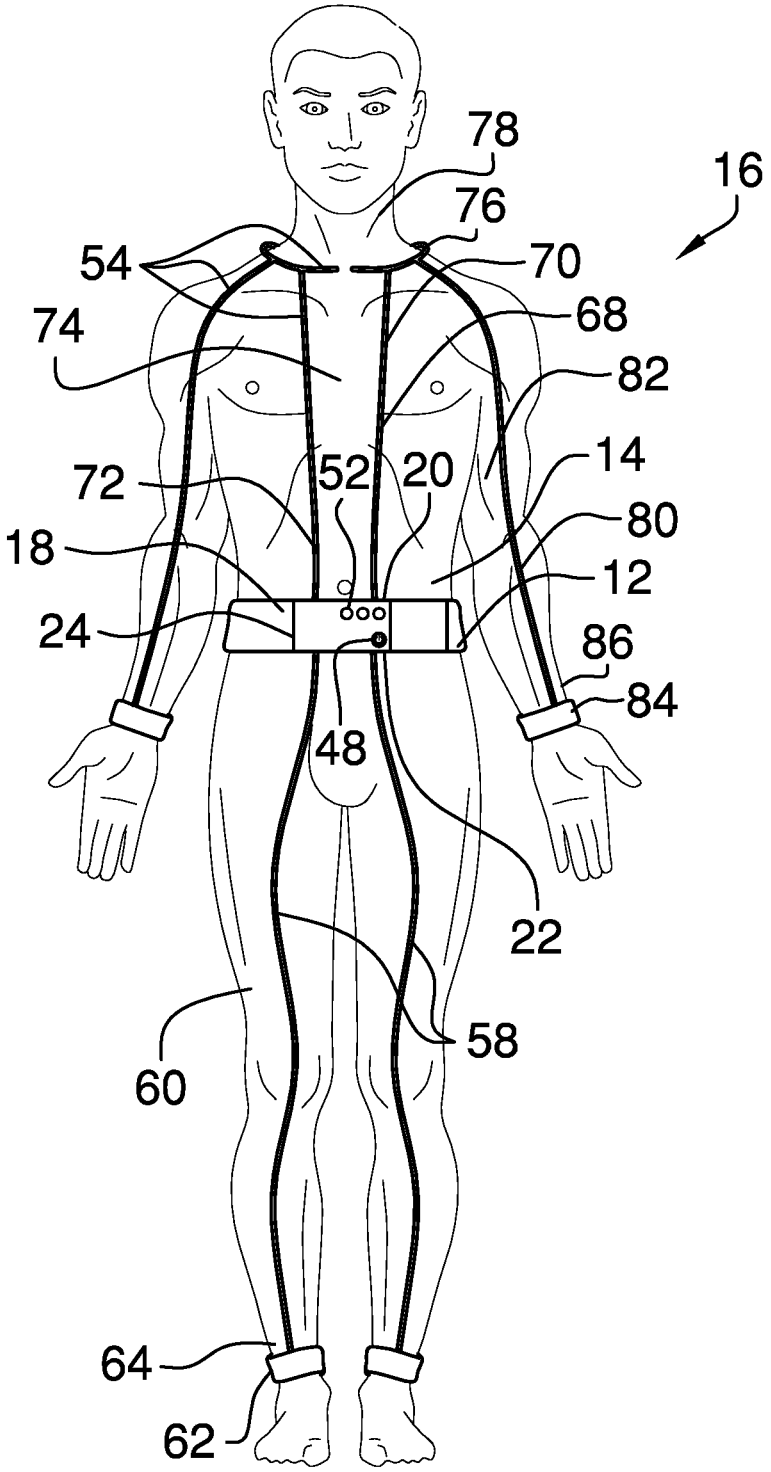
FIG. 1 is a front view of a body cooling assembly according to an embodiment of the disclosure.
Figure 2:
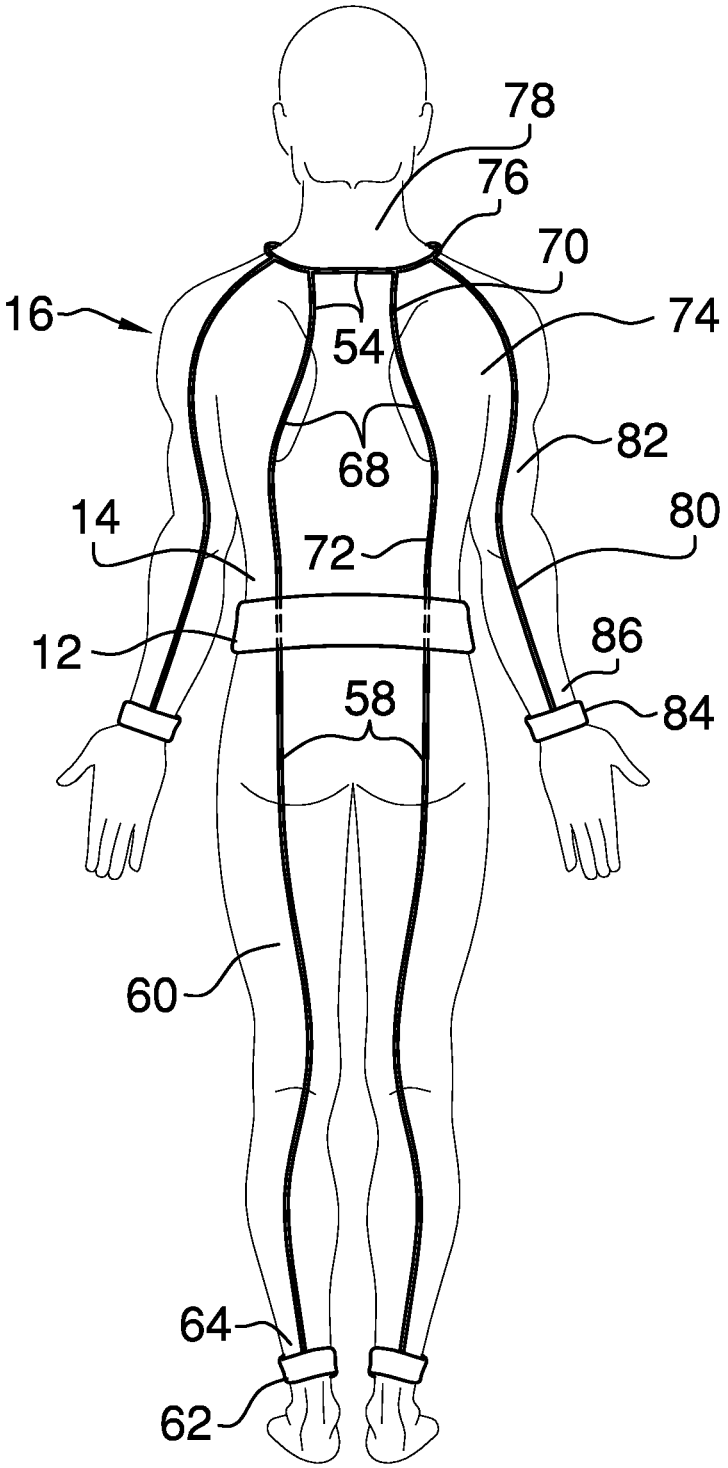
FIG. 2 is a back view of an embodiment of the disclosure.
Figure 3:
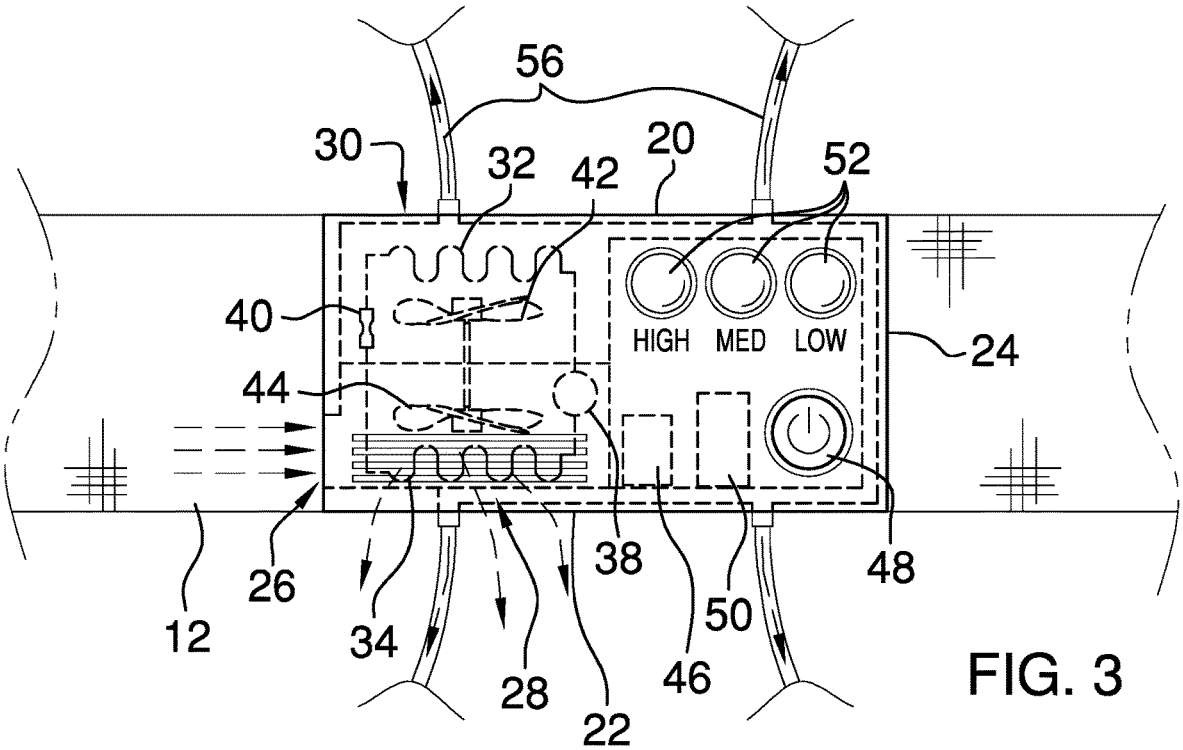
FIG. 3 is a cross-sectional view of an embodiment of the disclosure taken along line 3-3 of FIG. 2.
Figure 4:
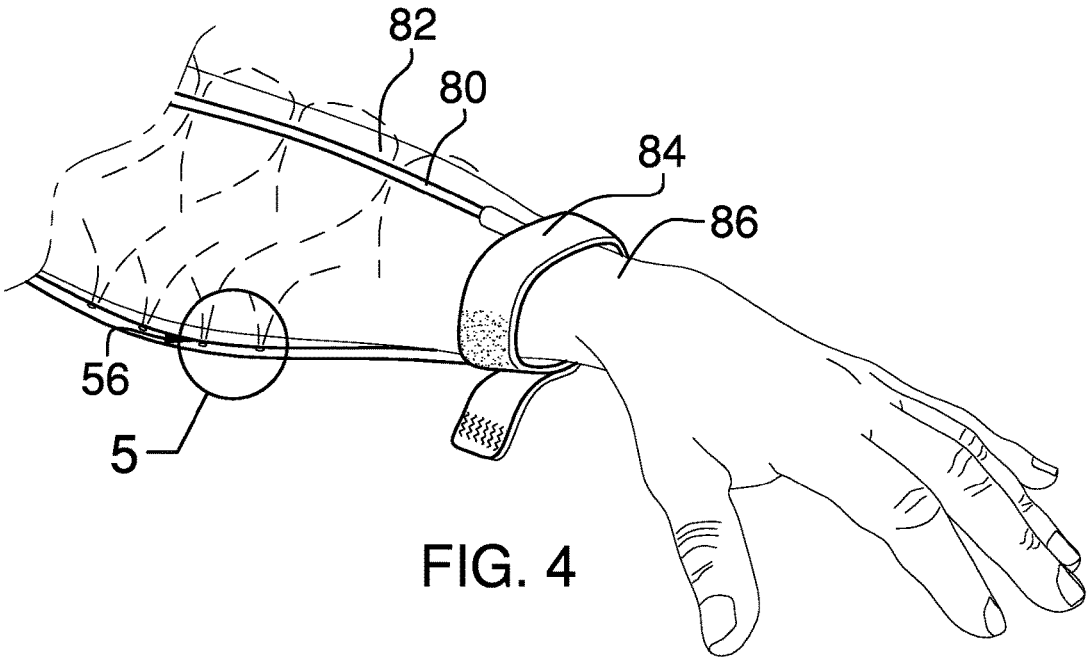
FIG. 4 is a broken side view of an arm portion of the disclosure.
Figure 5:
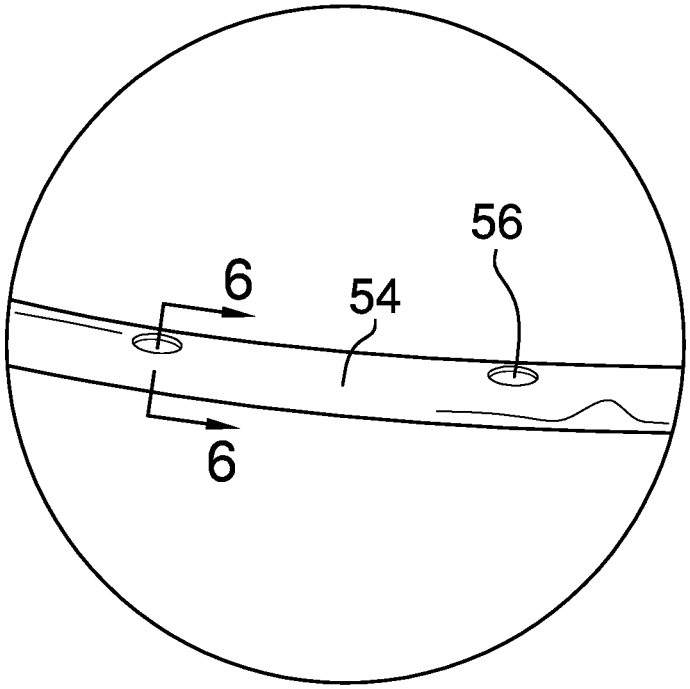
FIG. 5 is an enlarged side view of a tube of the disclosure of the area designated as "5" in FIG. 4.
Figure 6:
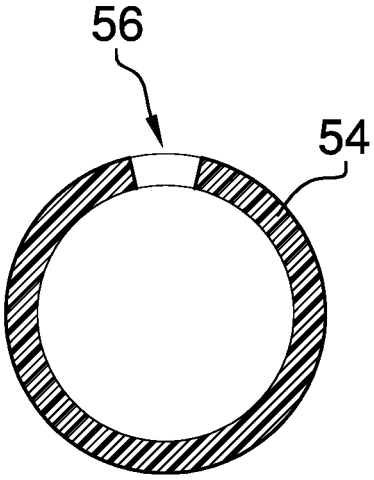
FIG. 6 is a cross-sectional view of an embodiment of the disclosure taken along line 6-6 of FIG. 5.

With reference now to the drawings, and in particular to FIGS. 1 through 6 thereof, a new cooling device embodying the principles and concepts of an embodiment of the disclosure and generally designated by the reference numeral 10 will be described.

As best illustrated in FIGS. 1 through 6, the body cooling assembly 10 generally comprises 10 a belt 12 that is extendable around a waist 14 of a person 16. A housing 18 is mounted on the belt 12 and has a top wall 20, a bottom wall 22 and a perimeter wall 24 that extends between and is attached to the top wall 20 and the bottom wall 22. The housing 18 has a first aperture 26 extending therein to intake ambient air from outside of the housing 18 and a second aperture 28 for expelling air outwardly from inside the housing 18.

A cooling unit 30 is mounted in the housing 18. The cooling unit 30 draws ambient air into the housing 18, cools the ambient air to define cold air and dispends the cold air outwardly from the housing 18. The cooling unit 30 includes a cooling coil 32 and a heating coil 34 that are in fluid communication with each other. A refrigerant 36 is positioned within the cooling 32 and heating coils 34. The refrigerant 36 releases heat in the heating coil 34 and absorbs heat in the cooling coil 32. A compressor 38 is fluidly coupled to both the cooling coil 32 and the heating coil 34. The compressor 38 pressurizes the refrigerant 36 from a gaseous state into a liquid state and transfers the refrigerant 36 from the cooling coil 32 into the heating coil 34 when actuated into an on position. An evaporator 40 is fluidly coupled to the cooling coil 32 and the heating coil 34. A first fan 42 is mounted in the housing 18 and directs air into the housing 18 and across the cooling coil 32 to define cold air. A second fan 44 is mounted in the housing 18 and directs air into the housing 18 and across the heating coil 34 and outwardly from the housing 18 through the second aperture 28.

Alternatively, the cooling unit 18 may be comprised of a loop containing fluid circulating a heatsink. The fluid may be water but should be understood as any other liquid suitable with a similar specific heat capacity. The heat sink has a fan that directs air across the loop, through the heatsink, and outwardly of the housing.

A control circuit 46 is electrically coupled to the compressor 38, the first fan 42 and second fan 44. A power switch 48 is electrically coupled to the control circuit 46. The control circuit 46 turns on the compressor 38, the first fan 42 and the second fan 44 when the power switch 48 is moved to an on position. A battery 50 is electrically coupled to the control circuit 46. A power level input 52 is electrically coupled to the control circuit 46. The power level input 52 is actuated to alter a speed of the first 42 and second fans 44.

A plurality of tubes 54 is fluidly coupled to the housing 18 and is in thermal communication with the cooling coil 32 such that air moves through the cooling coil 32 and exits the housing 18 through each of the tubes 54. Each of the tubes 54 has a plurality of vent holes 56 therein. Each of the vent holes 56 releases air from each of the tubes 54. Each of the tubes 54 comprises a plastic material. The plurality of tubes 54 includes a pair of leg portions 58 that is attached to and extends downwardly from the bottom wall 22. Each of the leg portions 58 is positionable on a separate leg 60 of the person 16. Each of the leg portions 58 is comprised of at least one tube 54. Each of the leg portions 58 is less than 40.0 inches in length and greater than 24.0 inches in length. A pair of ankle straps 62 is positionable around each ankle 64 of a person 16. Each of the leg portions 58 has one of the ankle straps 62 attached thereto. Each of the ankle straps 62 is releasably securable to one of a person's ankles 64 and may be secured by a hook-and-loop fastener or other fastening means 66.

The plurality of tubes 54 further includes a body portion 68 having an upper end 70 and a lower end 72. The lower end 72 is attached to and extends upwardly from the top wall 20. The body portion 68 is comprised of at least one tube 54. The body portion 68 is positionable over a torso 74 of the person 16. A neck portion 76 is attached to the upper end 70. The neck portion 76 is positionable around the neck 78 of the person. The neck portion 76 is comprised of at least one tube 54. The body portion 68 is adjacent to the torso 74 when the neck portion 76 is positioned around the neck 78.

The plurality of tubes 54 also includes a pair of arm portions 80 attached to and extending laterally from the neck portion 76. Each of the arm portions 80 is positionable over a separate arm 82 of the person 16. Each of the arm portions 80 comprises of at least one tube. Each of the arm portions is less than 35.00 inches in length and greater than 12.0 inches in length. A pair of wrist straps 84 is positionable around the wrists 86 of a person. Each of the arm portions 80 has one of the wrist straps 84 attached thereto.

In use, the belt strap 12 is worn conventionally as a belt 12 around the waist 14 of a person 16. Each of the tubes 54 are positioned on the body of the person 16 such that the wrist straps 84 are positioned on the wrist 86, the ankle straps 62 are positioned on the ankles 64 and the neck portion 76 is around the neck 78 of the person 16 holding the body portion 68 adjacent to the persons torso 74. The power switch 48 is moved into an on position actuating the cooling unit 30. The cooling unit 30 takes in ambient air, cools it and expends the cold air through the tubes 54 and pushes the hot air out the second aperture 28. The cold air flows through the tubes 54 and out each of the vent holes 56 blowing against the body of the person 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A cooling assembly for cooling parts of a body comprising:

a belt being configured to extend around a waist of a person;

a housing comprising a top wall, a bottom wall and a perimeter wall extending between and being attached to said top wall and said bottom wall, said housing being mounted on said belt, said housing having a first aperture extending therein to intake ambient air from outside of said housing, said housing having a second aperture for expelling air from inside said housing;

a cooling unit being mounted in said housing, said cooling unit drawing ambient air into said housing, cooling said ambient air to define cold air and dispending said cold air outwardly of said housing when said cooling unit is turned on; and a plurality of tubes each being fluidly coupled to said housing and being in thermal communication with said cooling unit such that air moved through said cooling unit exits said housing through said tubes, each of said tubes having a plurality of vent holes therein, each of said vent holes releasing air from each of said tubes, said tubes being configured to be positioned on parts of a body of the person, said plurality of tubes including a pair of leg portions being attached to and extending downwardly from said bottom wall, each of said leg portions being configured to be positioned on a separate leg of the person, each of said leg portions comprising at least one tube, a body portion having an upper end and a lower end, said lower end being attached to and extending upwardly from said top wall, said body portion comprising at least one tube, said body portion being configured to be positioned over a torso of the person, a neck portion being attached to said upper end, said neck portion being configured to be positioned around a neck of the person, said neck portion comprising at least one tube, said body portion being adjacent to the torso when said neck portion is positioned around the neck, a pair of arm portions being attached to and extending laterally from said neck portion, each of said arm portions being configured to be positioned over a separate arm of the person, each of said arm portions comprising at least one tube, and a pair of wrist straps, each of said arm portions having one of said wrist straps attached thereto.

2. The cooling assembly according to claim 1, wherein said cooling unit includes:

a cooling coil positioned within said housing;

a fan being mounted in said housing, said fan directing air into said housing and across said cooling coil to define cool air;

a control circuit being electrically coupled to said fan;

a power switch being electrically coupled to said control circuit, said control circuit turning on said fan when said switch is moved to an on position;

a battery being electrically coupled to said control circuit.

3. The cooling assembly according to claim 2, further including a power level input being electrically coupled to said control circuit, said power level input being actuated to alter a speed of said fan.

4. The cooling assembly according to claim 1, wherein each of said tubes comprises a plastic material.

5. The cooling assembly according to claim 1, wherein each of said leg portions is less than 40.0 inches in length and greater than 24.0 inches in length.

6. The cooling assembly according to claim 1, wherein each of said arm portions is less than 35.00 inches in length and greater than 12.0 inches in length.

7. A cooling assembly for cooling parts of a body comprising:

a belt being configured to extend around a waist of a person;

a housing comprising a top wall, a bottom wall and a perimeter wall extending between and being attached to said top wall and said bottom wall, said housing being mounted on said belt, said housing having a first aperture extending therein to intake ambient air from outside of said housing, said housing having a second aperture for expelling air from inside said housing;

a cooling unit being mounted in said housing, said cooling unit drawing ambient air into said housing, cooling said ambient air to define cold air and dispending said cold air outwardly of said housing when said cooling unit is turned on;

a plurality of tubes each being fluidly coupled to said housing and being in thermal communication with said cooling unit such that air moved through said cooling unit exits said housing through said tubes, each of said tubes having a plurality of vent holes therein, each of said vent holes releasing air from each of said tubes, said tubes being configured to be positioned on parts of a body of the person, said plurality of tubes including a pair of leg portions being attached to and extending downwardly from said bottom wall, each of said leg portions being configured to be positioned on a separate leg of the person, each of said leg portions comprising at least one tube, a body portion having an upper end and a lower end, said lower end being attached to and extending upwardly from said top wall, said body portion comprising at least one tube, said body portion being configured to be positioned over a torso of the person, a neck portion being attached to said upper end, said neck portion being configured to be positioned around a neck of the person, said neck portion comprising at least one tube, said body portion being adjacent to the torso when said neck portion is positioned around the neck, a pair of arm portions being attached to and extending laterally from said neck portion, each of said arm portions being configured to be positioned over a separate arm of the person, each of said arm portions comprising at least one tube, and a pair of ankle straps, each of said leg portions having one of said ankle straps attached thereto.

8. A cooling assembly for cooling parts of a body comprising:

a belt being configured to extend around a waist of a person;

a housing comprising a top wall, a bottom wall and a perimeter wall extending between and being attached to said top wall and said bottom wall, said housing being mounted on said belt, said housing having a first aperture extending therein to intake ambient air from outside of said housing, said housing having a second aperture for expelling air from inside said housing;

a cooling unit being mounted in said housing, said cooling unit drawing ambient air into said housing, cooling said ambient air to define cold air and dispending said cold air outwardly of said housing, said cooling unit including:

a cooling coil and a heating coil being in fluid communication with each other;

a refrigerant being positioned in said cooling and heating coils, said refrigerant releasing heat in said heating coil and absorbing heat in said cooling coil;

a compressor being fluidly coupled to said cooling coil and said heating coil said compressor pressurizing said refrigerant from a gaseous state into a liquid state and transferring said refrigerant from said cooling coil into said heating coil when actuated into an on position;

an evaporator being fluidly coupled to said cooling coil and said heating coil;

a first fan being mounted in said housing, said first fan directing air into said housing and across said cooling coil to define said cold air;

a second fan being mounted in said housing, said second fan directing air into said housing, across said heating coil and outwardly of said housing through said second aperture;

a control circuit being electrically coupled to said compressor, said first fan and second fan;

a power switch being electrically coupled to said control circuit, said control circuit turning on said compressor, said first fan and said second fan when said switch is moved to an on position;

a battery being electrically coupled to said control circuit;

a power level input being electrically coupled to said control circuit, said power level input being actuated to alter a speed of said first and second fans;

a plurality of tubes each being fluidly coupled to said housing and being in thermal communication with said cooling coil such that air moved through said cooling coil exits said housing through said tubes, each of said tubes having a plurality of vent holes therein, each of said vent holes releasing air from each of said tubes, each of said tubes comprising a plastic material, said plurality of tubes including:

a pair of leg portions being attached to and extending downwardly from said bottom wall, each of said leg portions being configured to be positioned on a separate leg of the person, each of said leg portions comprising at least one tube, each of said leg portions being less than 40.0 inches in length and greater than 24.0 inches in length;

a pair of ankle straps, each of said leg portions having one of said ankle straps attached thereto;

a body portion having an upper end and a lower end, said lower end being attached to and extending upwardly from said top wall, said body portion comprising at least one tube, said body portion being configured to be positioned over a torso of the person;

a neck portion being attached to said upper end, said neck portion being configured to be positioned around a neck of the person, said neck portion comprising at least one tube, said body portion being adjacent to the torso when said neck portion is positioned around the neck;

a pair of arm portions being attached to and extending laterally from said neck portion, each of said arm portions being configured to be positioned over a separate arm of the person, each of said arm portions comprising at least one tube, each of said arm portions being less than 35.00 inches in length and greater than 12.0 inches in length; and a pair of wrist straps, each of said arm portions having one of said wrist straps attached thereto.

* * * * *